US007997089B2

(12) United States Patent
Tsuyuki

(10) Patent No.: US 7,997,089 B2
(45) Date of Patent: Aug. 16, 2011

(54) METHOD AND APPARATUS FOR REGENERATION WATER

(75) Inventor: Ryosuke Tsuyuki, Tokorozawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 552 days.

(21) Appl. No.: 10/580,688

(22) PCT Filed: Nov. 25, 2004

(86) PCT No.: PCT/JP2004/017502

§ 371 (c)(1),
(2), (4) Date: May 26, 2006

(87) PCT Pub. No.: WO2005/052369

PCT Pub. Date: Jun. 9, 2005

(65) Prior Publication Data

US 2007/0125112 A1 Jun. 7, 2007

(30) Foreign Application Priority Data

Nov. 28, 2003 (JP) ..... 2003-399206

(51) Int. Cl.
*B01D 8/00* (2006.01)

(52) U.S. Cl. ..... 62/55.5; 417/901

(58) Field of Classification Search ..... 62/55.5; 417/901

See application file for complete search history.

(56) References Cited

U.S. PATENT DOCUMENTS 5,375,424 A 12/1994 Bartlett et al.
6,122,921 A * 9/2000 Brezoczky et al. ..... 62/55.5

FOREIGN PATENT DOCUMENTS

| | | | |
|---|---|---|---|
| JP | 04-303186 | A | 10/1992 |
| JP | 06-346848 | A | 12/1994 |
| JP | 08-061232 | A | 3/1996 |
| JP | 08-507115 | A | 7/1996 |
| JP | 09-014133 | A | 1/1997 |
| JP | 09-144655 | A | 6/1997 |
| JP | 2000-274356 | A | 10/2000 |
| WO | WO-94/19608 | A | 9/1994 |

OTHER PUBLICATIONS

International Search Report.

* cited by examiner

*Primary Examiner* — Cheryl J Tyler
*Assistant Examiner* — John F Pettitt
(74) *Attorney, Agent, or Firm* — Rader, Fishman & Grauer PLLC

(57) ABSTRACT

Ice condensed in a portion in a case in which a cryogenic refrigerator is installed, which is cooled by the cryogenic refrigerator, is melted by increasing a temperature of the ice to a melting point of the ice or higher. Then, while the temperature of the melted ice and a pressure thereof are kept to be equal to or higher than a freezing point of water, the pressure is reduced by rough evacuation so as to vaporize water. At a time at which the water is discharged, the pressure is further reduced so as to discharge water vapor. In this manner, regeneration of water is performed in accordance with a state of the water (i.e., a solid state, a liquid state, and a gas state), thereby shortening a regeneration time.

14 Claims, 9 Drawing Sheets

$t_1$ Time when a temperature of the portion of the case in which the ice is condensed reaches the melting point of the ice $T_1$ Temperature of the melting point of the ice, i.e. 273K $t_1$ Time when a temperature of the portion of the case in which the ice is condensed reaches the melting point of the ice $T_1$ Temperature of the melting point of the ice, i.e. 273K $t_1$ Time when a temperature of the portion of the case in which the ice is condensed reaches the melting point of the ice $T_1$ Temperature of the melting point of the ice, i.e. 273K

METHOD AND APPARATUS FOR REGENERATION WATER

TECHNICAL FIELD

The present invention relates to a water regeneration method and a water regeneration apparatus. In particular, the present invention relates to a water regeneration method and a water regeneration apparatus for discharging ice condensed in a portion cooled by a cryogenic refrigerator installed in a case to the outside of the case, which are suitably used for discharging water that is condensed as ice on a cryopanel in a cryopump out.

BACKGROUND ART

A cryopump is conventionally used for evacuation of a vacuum chamber (that may be called as a process chamber) of a semiconductor manufacturing apparatus or the like in order to keep the inside of the vacuum chamber vacuum.

An exemplary use of the cryopump described in Japanese Patent Laid-Open Publication No. 2000-274356 is shown in FIG. 1 (plan view) and FIG. 2 (vertical cross-sectional view).

The cryopump 20 includes a two-stage GM (Gifford-McMahon) expansion type refrigerator 24 that works by receiving supply of compressed helium gas from a compressor 22, for example. The refrigerator 24 includes a first (cooling) stage 26 and a second (cooling) stage 28 having a lower temperature than the first stage 26. A heat shield 30 is connected to the first stage 26, thereby preventing a radiation heat from entering the second stage 28 and a cryopanel 34. A louver 32 is provided in a vacuum-chamber side opening of the heat shield 30. To the second stage 28 is connected the cryopanel 34 (that may be called as a second-stage panel because it is connected to the second stage 28) including activated charcoal 36.

In FIGS. 1 and 2, the reference numeral 40 denotes a rough valve to which a dry pump (not shown) is connected, the reference numeral 42 denotes a relief valve for releasing a gas accumulated in the cryopump, the reference numeral 44 denotes a purge valve for introducing a purge gas (e.g., nitrogen gas), the reference numeral 46 denotes a pressure sensor, the reference numeral 48 denotes a connector for a temperature sensor, and the reference numerals 48*a* and 48*b* denote temperature sensors for the first stage 26 and the second stage 28, respectively.

The cryopump 20 having the above structure is connected to a vacuum chamber 10 via a gate valve 12. The louver 32 and the heat shield 30 that are cooled to about 40 K to about 120 K cool a gas having a relatively high freezing point such as water vapor so as to condense that gas. Moreover, the cryopanel 34 cooled to 10 K to 20 K cools a gas having a low freezing point such as nitrogen gas or argon gas so as to condense that gas. A gas that is not condensed by the above cooling, such as hydrogen gas, is absorbed by the activated charcoal 36. In this manner, gases inside the vacuum chamber 10 are discharged.

As described above, the cryopump 20 is an accumulation type pump and therefore requires a regeneration process for discharging accumulated gases to the outside of the cryopump 20 when the amount of the accumulated gases reaches a certain amount.

Examples of conventional regeneration methods include (1) a method in which temperatures of the louver 32, the heat shield 30, and the cryopanel 34 are increased by using a heater or the like at the same time as start regeneration and thereafter a purge gas (e.g., nitrogen gas) is kept flowing, as described in Japanese Patent Laid-Open Publications Nos. Hei 8-61232 and Hei 6-346848, and (2) a method in which roughing and purging are repeated (hereinafter, referred to as rough-and-purge), as described in Japanese Patent Laid-Open Publication No. Hei 9-14133.

FIG. 3 shows an exemplary procedure using the rough-and-purge, and FIG. 4 shows an example of changes in a pressure and a temperature.

In FIG. 3, Step 100 is a procedure for increasing temperatures of respective parts in a cryopump case, Step 110 is a procedure of the rough-and-purge, Step 130 is a procedure of buildup determination for detecting that discharge of water or gas is finished from a pressure increase ratio when the roughing by the vacuum pump is stopped, for example, and Step 140 is a procedure for cooling down the parts to temperatures that are required for an operation of the cryopump.

DISCLOSURE OF THE INVENTION

In regeneration of the cryopump described above, regeneration of water becomes a problem. Ice that has resulted from water vapor evacuated and condensed by and in the cryopump cannot be melted, unless its temperature is increased to its melting point, 273 K or higher, at an atmospheric pressure. The boiling point of water is 373 K at the atmospheric pressure. However, it is difficult to increase the temperature to 373 K because of structures of the cryopump and the refrigerator. This means that ice cannot be discharged from the inside of the cryopump only by increasing the temperature, unlike other gases that can be placed in a gas state during the temperature increase of the cryopump and can be discharged to the outside of the cryopump. Insufficient regeneration of water affects an evacuating performance of the cryopump.

In the conventional regeneration method (1) in which a purge gas is kept flowing so that water is saturated in the purge gas and is discharged from the inside of the cryopump, it is difficult to determine whether or not regeneration is completed. Moreover, the purge gas is made to flow only for a time determined in accordance with an assumed amount of the water. Thus, it is necessary to make the gas flow for a long period of time so as to finish discharging of the water under a worst condition and therefore wasteful time is very long.

In the latter method (2), as shown in FIG. 4, warm-up is started at Point A (Step 100 in FIG. 3). In the warm-up, the temperature is increased by heating by means of a heater (see Japanese Patent Laid-Open Publication No. 2000-274356) or by performing a reverse rotation, i.e., rotating a motor of the refrigerator in an opposite direction to a rotation direction during cooling (Japanese Patent Laid-Open Publication No. Hei 7-35070), and temperatures of respective parts in the cryopump are increased by making a purge gas (e.g., nitrogen gas) flow. Then, at Point B at which the internal temperature is equal to or higher than a melting point of ice, purging is stopped, and the rough valve 40 connected to a vacuum pump for roughing (an example of this vacuum pump is a dry pump and this vacuum pump is hereinafter called as a dry pump) is opened to perform evacuation, so that a pressure is reduced. At Point C at which the pressure is reduced and reaches a set pressure P1 (e.g., 10 Pa), the rough valve 40 is closed and the purge gas is introduced again, thereby increasing the pressure. Those operations are repeated while the pressure is monitored (Step 110 in FIG. 3). At Point D at which the number of repetitions reaches a predetermined number or Point H at which pressure increase to a set pressure P2 within a set time does not occur without introduction of the purge gas, the rough-and-purge step is ended and the rough valve 40 is opened again so that evacuation is performed by means of the dry pump. At Point I at which the pressure reaches the set value P1, the rough valve 40 is closed. Then, at Point J at which the pressure naturally reaches a set value P3 without making the purge gas flow, the rough valve 40 is opened again and evacuation is performed. Those operations are repeated (Step 130 in FIG. 3). At Point K at which the pressure is not increased to Point J, cool-down is started (Step 140 in FIG. 3).

However, in the latter method (2), water is frozen during roughing by means of the dry pump. Thus, water is not sufficiently discharged and the pressure is not reduced to the set value. Therefore, a time required for regeneration becomes longer in some cases. Moreover, it is necessary to perform the rough-and-purge step again in some cases.

It is therefore an object of the present invention to efficiently discharge water and shorten a regeneration time, thereby overcoming the aforementioned conventional problems.

According to the present invention, a water regeneration method for discharging ice condensed in a portion cooled by a cryogenic refrigerator installed in a case to an outside of the case, includes: a temperature increasing step for melting the ice; a vaporizing step for vaporizing water; and a discharging step for discharging water vapor, wherein the ice, the water, and the water vapor are regenerated in stages, thereby achieving the above object.

Moreover, each of the vaporizing step and the discharging step may include buildup determination.

The temperature increasing step may be a warm-up step for increasing a temperature of the portion of the case in which the ice is condensed to a melting point of the ice or higher to melt the ice.

Moreover, the temperature increasing step may be performed by one or more of temperature increase by a reverse rotation in which a motor of the refrigerator is rotated in an opposite direction to a rotation direction during cooling, temperature increase by purge in which a purge gas having a higher temperature than the melting point of the ice is made to flow in the case to return a pressure in the case that is kept vacuum to an atmospheric pressure and improve thermal conductivity with the outside of the case, and temperature increase by a heater.

In the vaporizing step, water is vaporized by performing rough evacuation to reduce a pressure of the portion in which the water generated from melting of the ice by the temperature increasing step is accumulated within a range in which the temperature and the pressure of the portion are prevented from reaching a freezing point of the water, the buildup determination for determining pressure increase by discharged moisture or a gas when the evacuation is stopped is performed, and the water vaporization and the buildup determination are repeated until the water vanishes away.

The pressure during the rough evacuation may be set to 100 Pa to 200 Pa to prevent the water from being frozen.

The discharging step may be an evacuation step for discharging the water vapor by further reducing the pressure by the rough evacuation at a time when the water is vaporized by the vaporizing step, performing the buildup determination to determine the pressure increase by a gas when the evacuation is stopped, and repeating the discharge of the water vapor and the buildup determination until the pressure increase is smaller than a value used for the determination.

The temperature increasing step may be switched to the vaporizing step at a time when the temperature of the portion of the case in which the ice is condensed reaches the melting point of the ice.

The vaporizing step may be switched to the evacuation step based on the buildup determination using the discharged moisture or gas when the evacuation is stopped.

According to the present invention, a water regeneration apparatus for discharging ice condensed in a portion cooled by a cryogenic refrigerator installed in a case to an outside of the case, includes: temperature increasing means for increasing a temperature of the portion in the case in which the ice is condensed to a melting point of the ice or higher to melt the ice; vaporizing means for vaporizing water generated by melting of the ice by performing rough evacuation to reduce a pressure of the portion in which the water is accumulated within a range in which the temperature and the pressure of the portion are prevented from reaching a freezing point of the water, performing buildup determination based on discharged moisture or gas when the evacuation is stopped, and repeating the water vaporization and the buildup determination until the water vanishes away; and evacuation means for discharging water vapor by further reducing the pressure at a time when the water is vaporized, thereby achieving the above object.

The temperature increasing means may be achieved by one or more of a reverse rotation of a motor of the refrigerator, a purge gas, and a heater.

The present invention also provides a cryopump or a water trap that is characterized by including the aforementioned water regeneration apparatus.

According to the present invention, regeneration of water, which is the problematic issue during regeneration, is divided into three steps, i.e., melting ice, vaporizing water, and discharging water vapor. In each of the three steps, a regeneration condition (pressure, temperature) that is appropriate for a corresponding state (i.e., a solid state, a liquid state, a gas state) is used, so that ice is melted by increasing a temperature of the ice itself, water generated from melting of the ice is vaporized by self-evaporation by performing rough evacuation to a pressure at which the water is not frozen, and water vapor distributed on a surface of a structure is completely discharged at a further reduced pressure. In this manner, regeneration of the water is performed in stages, namely, in an ice state, in a water state, and in a water-vapor state in that order in accordance with the state of the water. Thus, it is possible to efficiently reprocess the water and shorten a regenerate time.

BEST MODE FOR CARRYING OUT THE INVENTION

An exemplary embodiment of the present invention is now described in detail with reference to the drawings.

Figure 1:
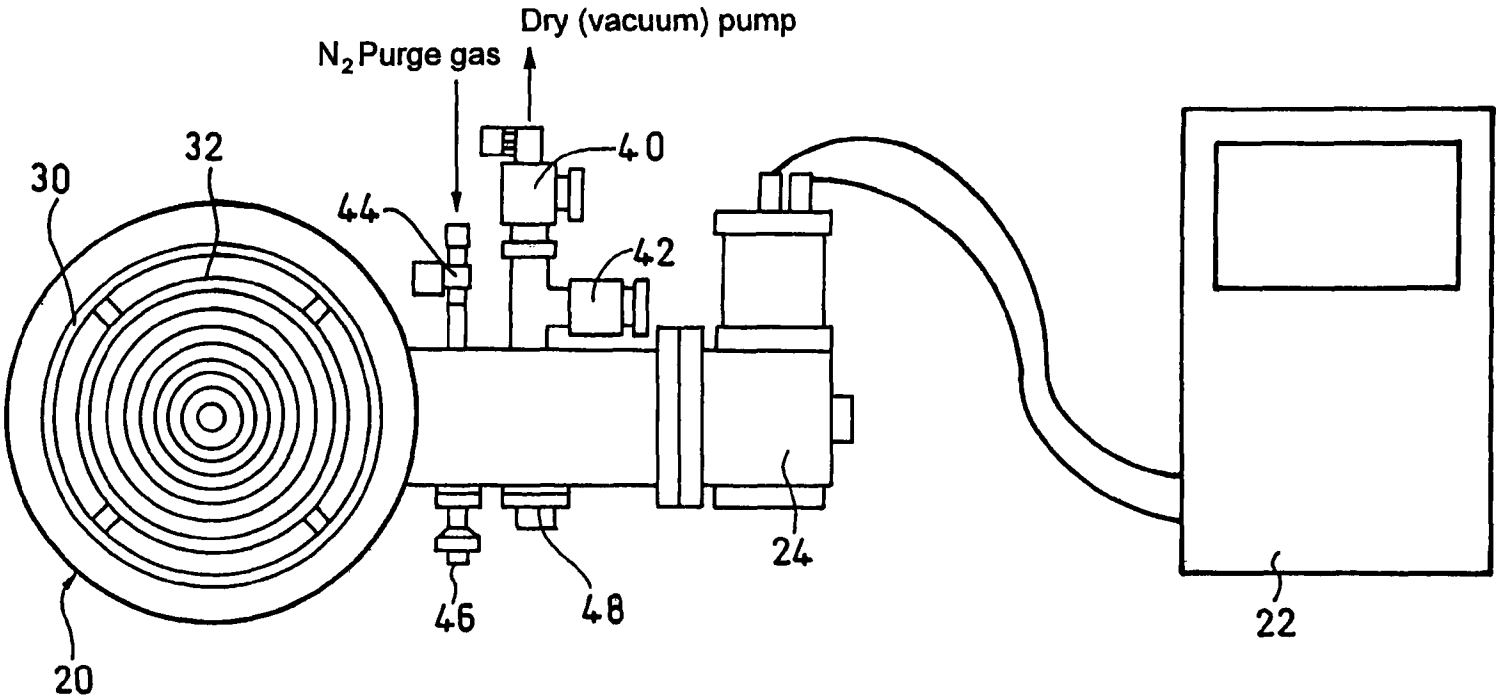
Fig. 1 PRIOR ART
FIG. 1 is a plan view showing an exemplary structure of a cryopump.
Figure 2:
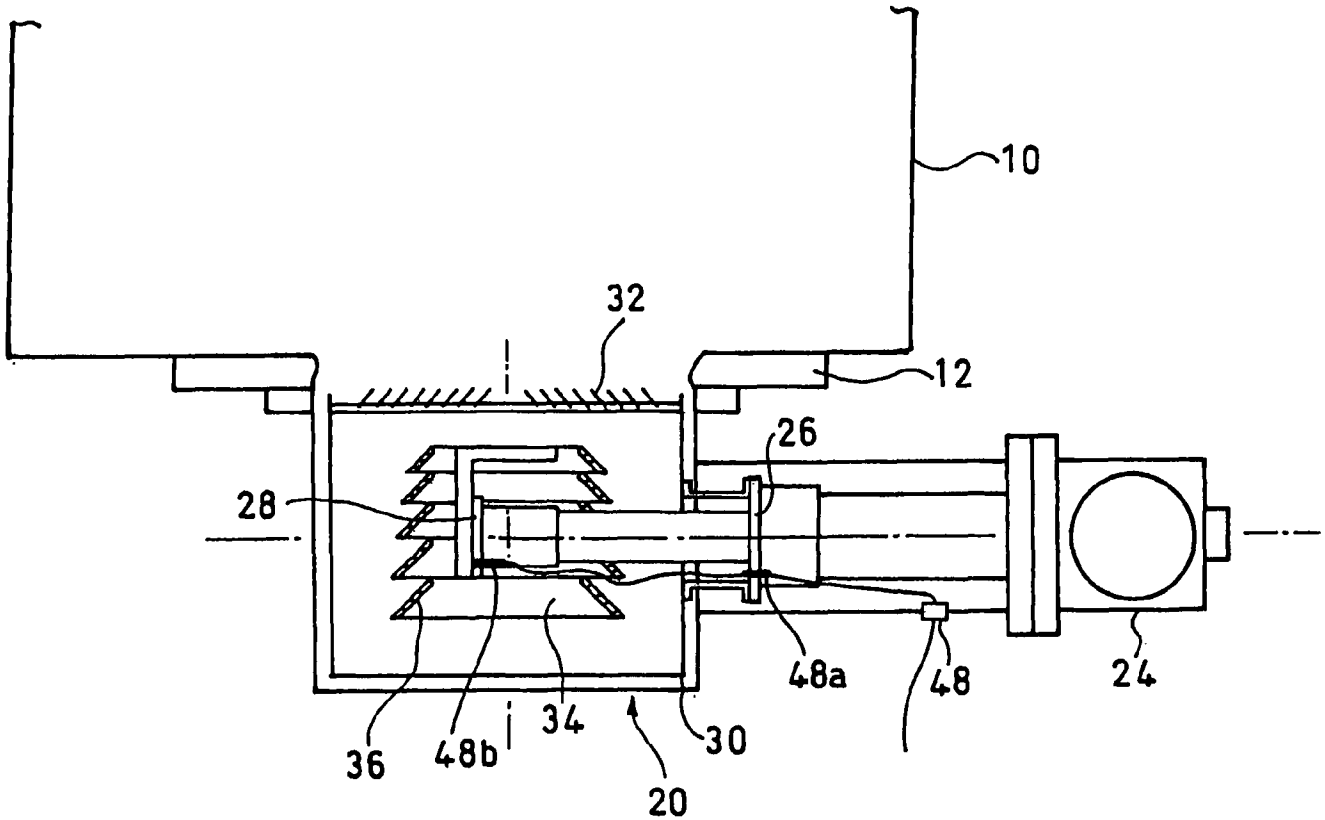
Fig. 2 PRIOR ART
FIG. 2 is a vertical cross-sectional view showing the exemplary structure of the cryopump.
Figure 3:
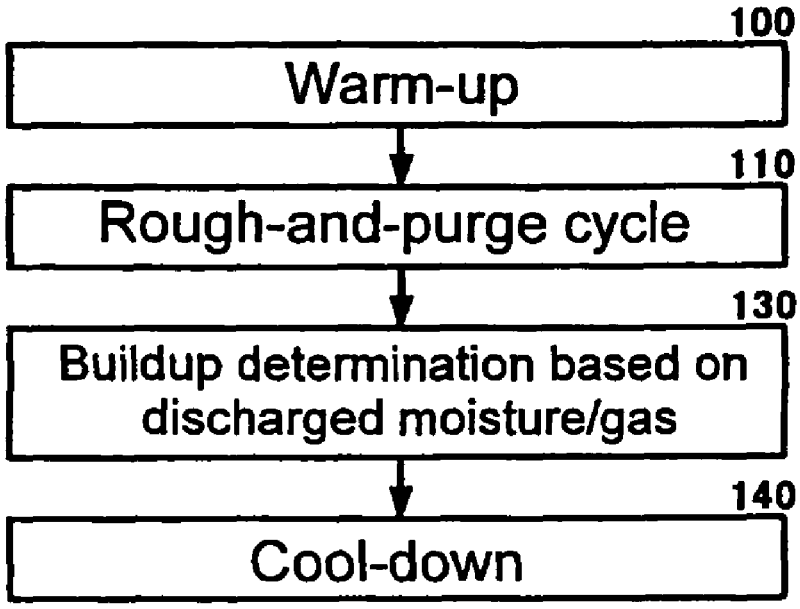
Fig. 3 PRIOR ART
FIG. 3 is a flowchart for showing an exemplary procedure of a conventional water regeneration method.
Figure 4:
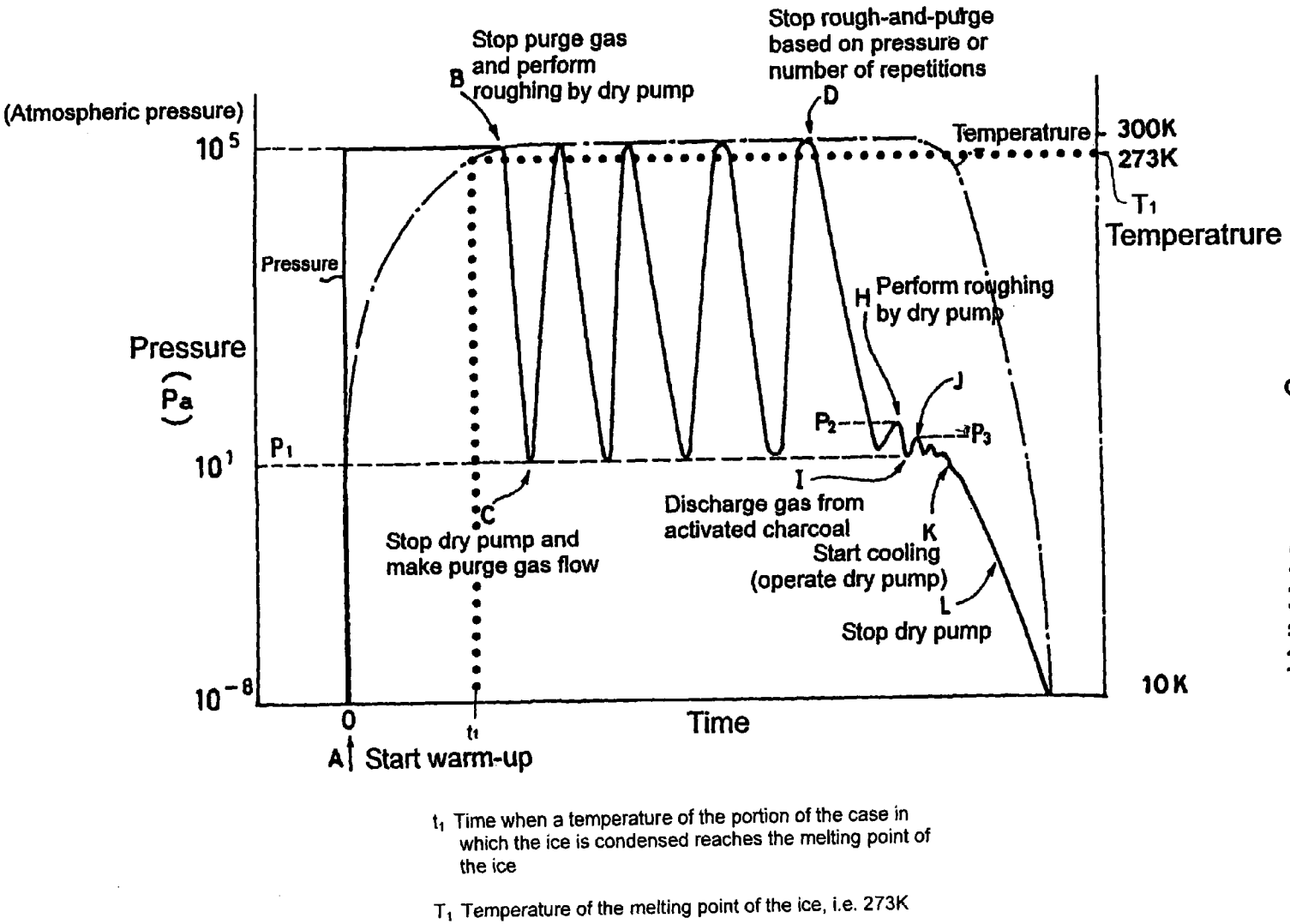
Fig. 4 PRIOR ART
FIG. 4 is a time chart of the exemplary procedure of the conventional water regeneration method.
Figure 5:
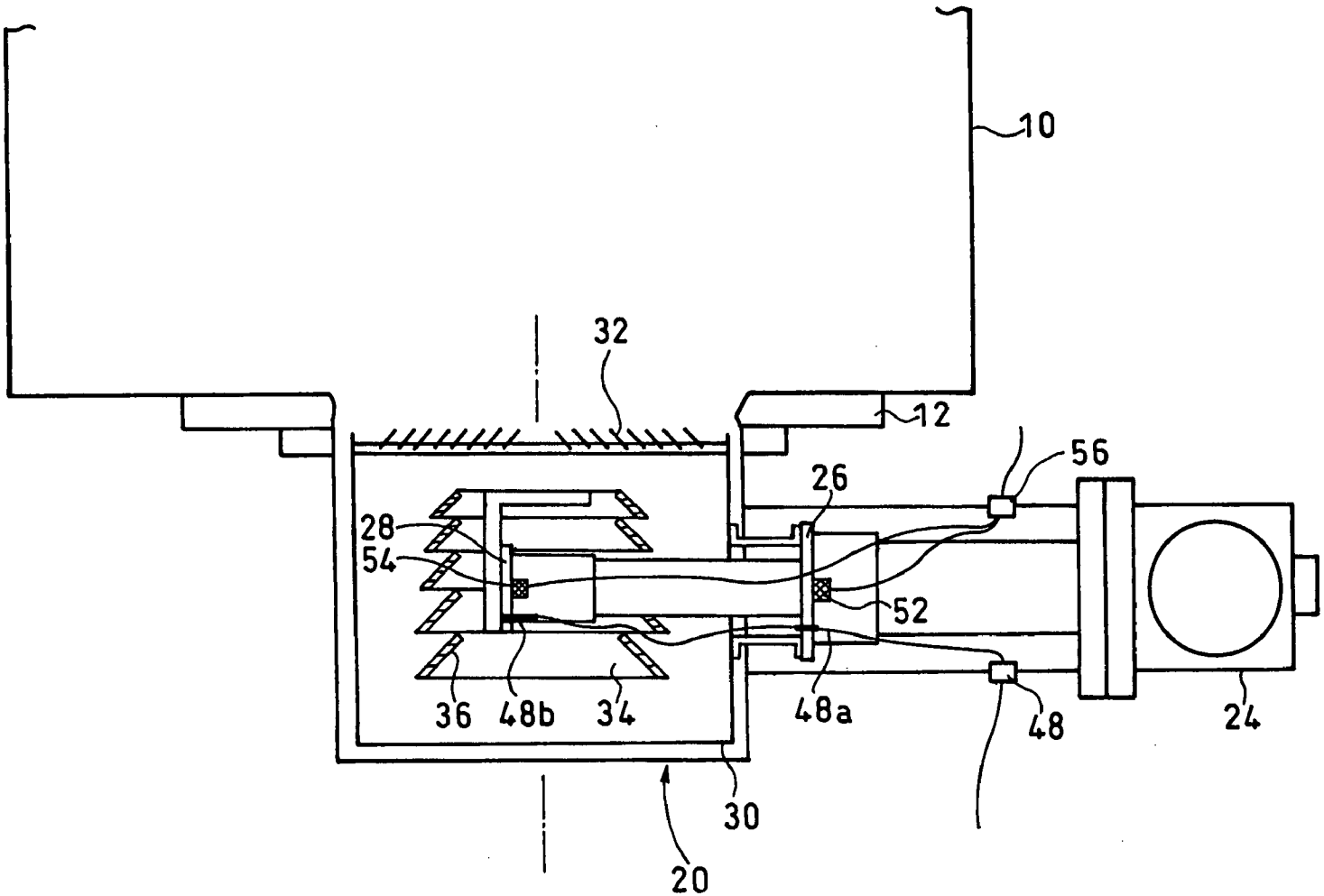
FIG. 5 is a vertical cross-sectional view showing an exemplary structure of a cryopump to which the present invention is applied.

FIG. 5 shows an exemplary cryopump to which the exemplary embodiment of the present invention is applied. A heater 52 for the first stage 26 and a heater 54 for the second stage 28 are added to the structure shown in FIG. 2. The reference numeral 56 in FIG. 5 denotes a connector for a heater.

Figure 6:
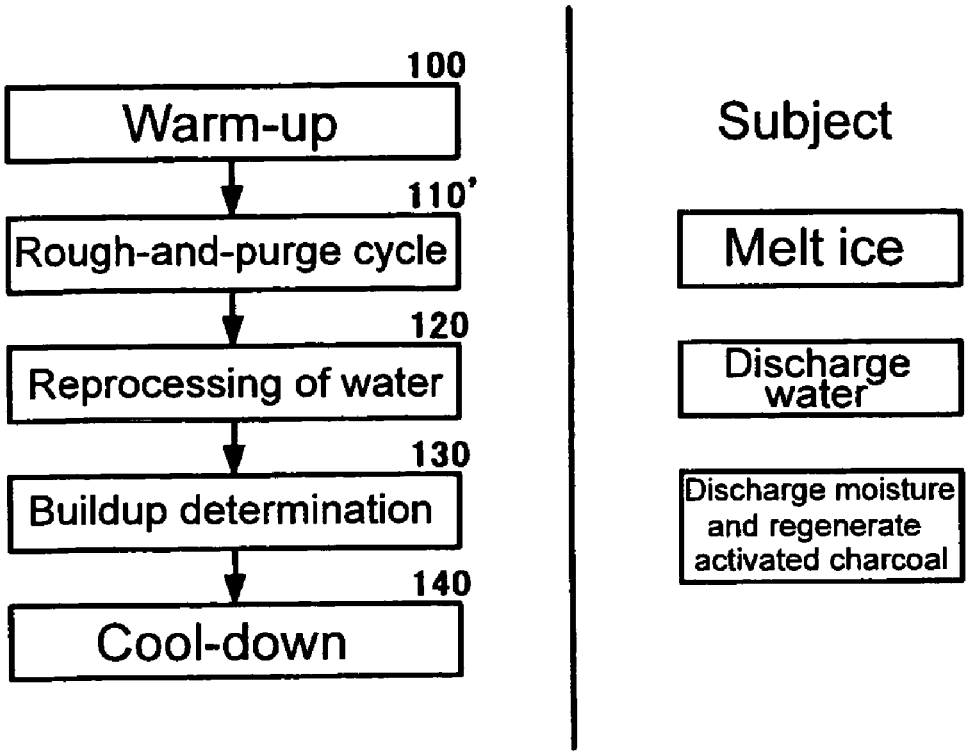
FIG. 6 is a flowchart for showing a water regeneration procedure according to an exemplary embodiment of the present invention.
Figure 7:
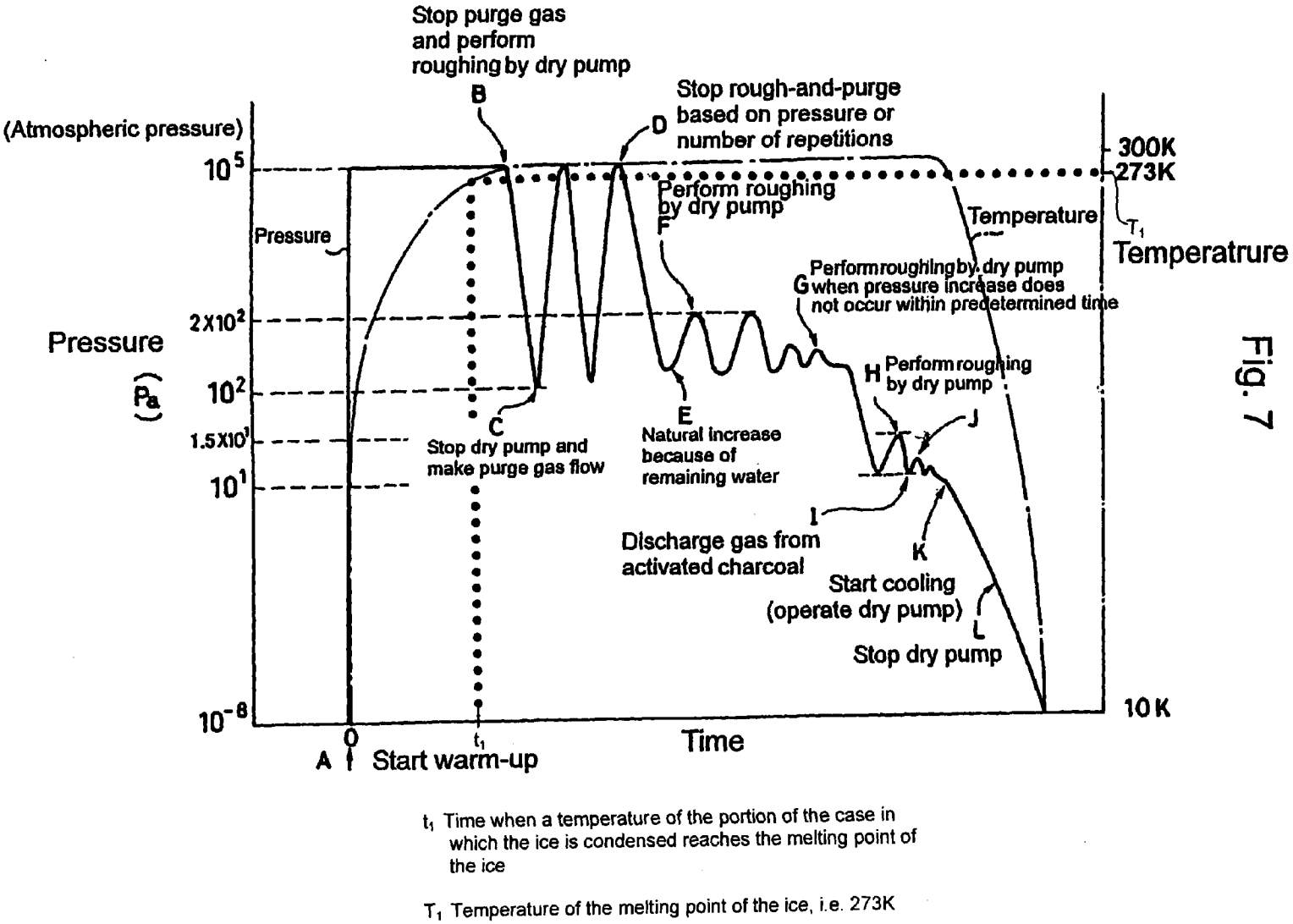
FIG. 7 is a time chart of the water regeneration procedure of the exemplary embodiment of the present invention.

Regeneration of water according to the present invention is performed in a procedure shown in FIG. 6. Referring to FIG. 7, warm-up is started at Point A as in the conventional method. In the warm-up, while a temperature is increased by a reverse rotation or by the heaters 52 and 54, for example, $N_2$ gas (purge gas) is made to flow in order to improve thermal conductivity with the outside of the case (Step 100 in FIG. 6). Then, a rough-and-purge cycle is started at Point B (step 110' in FIG. 6). In this cycle, a lower limit of a pressure is set to a value higher than a lower limit (e.g., 10 Pa) in the conventional method, for example, 100 Pa, so as to prevent water from being frozen. At Point D, purge is stopped. The above operations are then repeated. The rough-and-purge cycle is stopped based on the pressure or the number of repetitions as in the conventional method. When an operation of the dry pump is stopped at Point E, the pressure naturally increases because of remaining water. Thus, at Point F, roughing is performed by means of the dry pump. Those operations are repeated so as to discharge water (Step 120 in FIG. 6). At Point G at which pressure increase does not occur within a predetermined time after stop of the dry pump, it is determined that water is drained and roughing by means of the dry pump is performed. Then, a step for stopping the dry pump and waiting for gas discharge from activated charcoal at Point I at which the pressure is low (e.g., about 10 Pa) and a step for performing roughing by the dry pump at Point H are repeated (Step 130 in FIG. 6). Then, at Point K at which the pressure increase does not occur, cooling is started and the dry pump is operated. At Point L, the dry pump is stopped and an operation of the cryopump is started (Step 140 in FIG. 6).

In the present exemplary embodiment, the heaters 52 and 54 are provided. Thus, all of temperature increase by a reverse rotation, temperature increase by a heater, and temperature increase by purge can be used. Therefore, it is possible to rapidly increase the temperature. Moreover, any one of the above temperature increase methods or a combination of given two of those methods may be used for increasing the temperature. Furthermore, the heater may be omitted.

Figure 8:
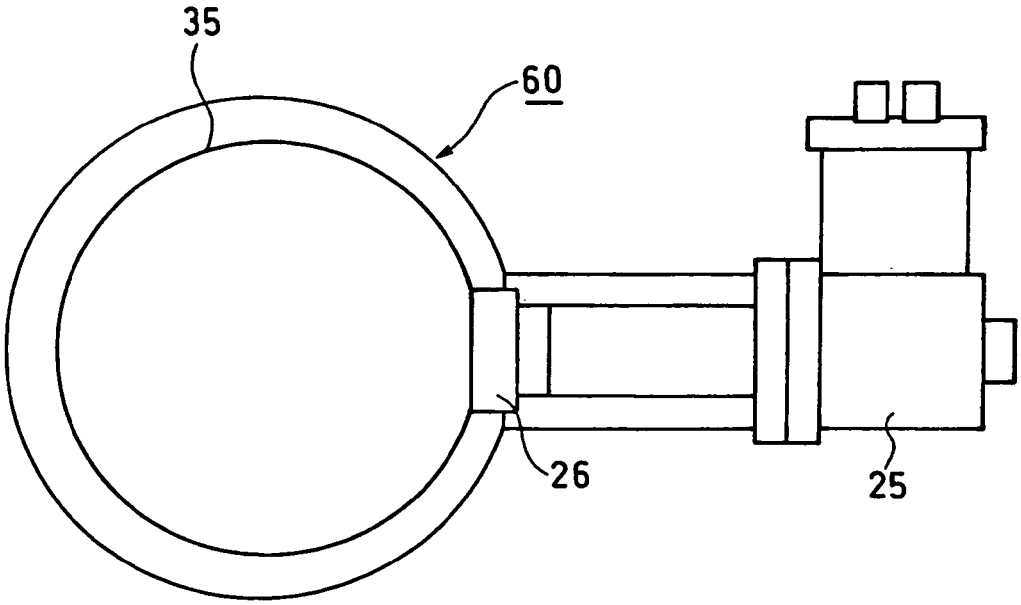
FIG. 8 is a plan view showing an exemplary structure of a water trap to which the present invention is applied.
Figure 9:
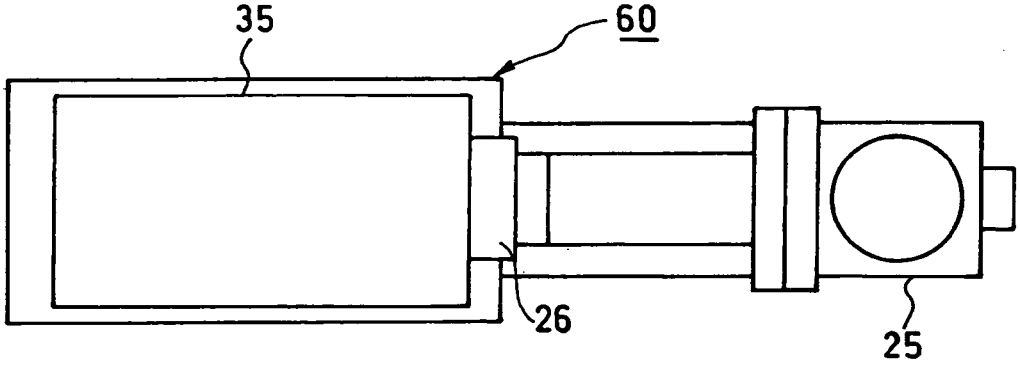
FIG. 9 is a vertical cross-sectional view showing the exemplary structure of the water trap.
Figure 10:
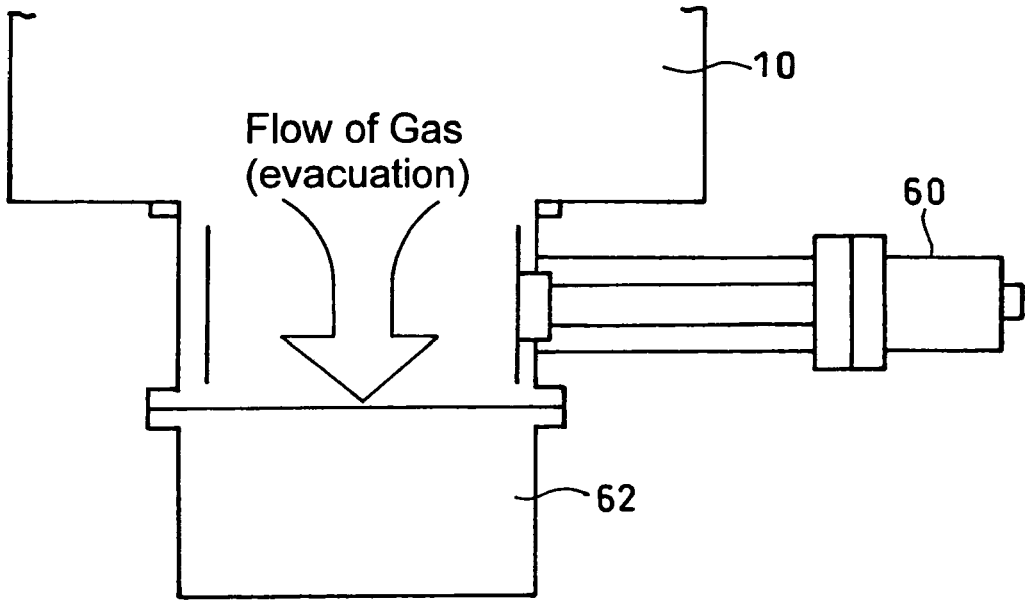
FIG. 10 is a vertical cross-sectional view showing a state in which the water trap is attached to an apparatus.

In the exemplary embodiment, the present invention is applied to the cryopump. However, an application of the present invention is not limited thereto. As shown in FIG. 8 (plan view) and FIG. 9 (vertical cross-sectional view), the present invention can be applied to a water trap (that may be called as a cryo trap) 60 described in Japanese Patent Laid-Open Publication No. Hei 10-122144, for example, in a similar manner. The water trap 60 is often attached to the vacuum chamber 10 in combination with a turbo-molecular pump 62, as exemplified in FIG. 10, and is configured to perform evacuation by condensing water in a cryopanel 35 that is cooled using a single stage refrigerator 25 including only the first stage 28.

INDUSTRIAL APPLICABILITY

The present invention can be also applied to apparatuses other than a cryopanel and a water trap, in which it is necessary to discharge ice (water, water vapor) that is accumulated because of cooling by a refrigerator or the like, e.g., a professional-use refrigerator, in general.

The invention claimed is:

1. A water regeneration method for discharging ice condensed in a portion cooled by a cryogenic refrigerator installed in a case to an outside of the case, comprising:

a temperature increasing step for melting the ice into water at approximately atmospheric pressure and at a melting temperature of at least 273 K;

a vaporizing step for vaporizing water by performing a plurality of first roughing steps between the approximate atmospheric pressure and a first reduced pressure being less than the atmospheric pressure but higher than and yet close to a water-freezing pressure that causes the water to freeze;

a water discharge step for discharging water by performing a plurality of second roughing steps between a second reduced pressure and the first reduced pressure, the second reduced pressure being less than the atmospheric pressure and greater than the first reduced pressure; and a water vapor discharging step for discharging water vapor by performing a plurality of third roughing steps between a third reduced pressure and a fourth reduced pressure, the third and fourth reduced pressures being less than the first reduced pressure and the third reduced pressure being greater than the fourth reduced pressure, wherein each one of the vaporizing step, the water discharge step and the water vapor discharging step occurs at the melting temperature of at least 273 K.

2. The water regeneration method according to claim 1, wherein each of the vaporizing step and the discharging step includes buildup determination.

3. The water regeneration method according to claim 1, wherein the temperature increasing step is a warm-up step for increasing a temperature of the portion of the case in which the ice is condensed to a melting point of the ice or higher to melt the ice.

4. The water regeneration method according to claim 1, wherein the temperature increasing step is performed by one or more of temperature increase by a reverse rotation in which a motor of the refrigerator is rotated in an opposite direction to a rotation direction during cooling, temperature increase by purge in which a purge gas having a higher temperature than the melting point of the ice is made to flow in the case to return a pressure in the case that is kept at vacuum to an atmospheric pressure and improve thermal conductivity with the outside of the case, and temperature increase by a heater.

5. The water regeneration method according to claim 1, wherein, in the vaporizing step, water is vaporized by performing rough evacuation to reduce a pressure of the portion in which the water generated from melting of the ice by the temperature increasing step is accumulated within a range in which the temperature and the pressure of the portion are prevented from reaching a freezing point of the water, a buildup determination for determining pressure increase by discharged moisture or a gas when the evacuation is stopped is performed, and the water vaporization and the buildup determination are repeated until the water vanishes away.

6. The water regeneration method according to claim 5, wherein the first reduced pressure is set to approximately 100 Pa and the second reduced pressure is set to approximately 200 Pa.

7. The water regeneration method according to claim 1, wherein the discharging step is an evacuation step for discharging the water vapor by further reducing the pressure by the rough evacuation at a time when the water is vaporized by the vaporizing step, performing a buildup determination to determine the pressure increase by a gas when the evacuation is stopped, and repeating the discharge of the water vapor and the buildup determination until the pressure increase is smaller than a value used for the determination.

8. The water regeneration method according to claim 1, wherein the temperature increasing step is switched to the vaporizing step at a time when a temperature of the portion of the case in which the ice is condensed reaches the melting point of the ice.

9. The water regeneration method according to claim 5, wherein the vaporizing step is switched to the discharge step based on the buildup determination using the discharged moisture or gas when the evacuation is stopped.

10. A water regeneration apparatus for discharging ice condensed in a portion cooled by a cryogenic refrigerator installed in a case to an outside of the case, comprising:

temperature increasing means for melting the ice into water at approximately atmospheric pressure and at a melting temperature of at least 273 K;

vaporizing means for vaporizing the water by performing a plurality of first roughing steps between the approximate atmospheric pressure and a first reduced pressure being less than the atmospheric pressure but higher than and yet close to a water-freezing pressure that causes the water to freeze;

water discharge means for discharging water to the outside of the case by performing a plurality of second roughing steps between a second reduced pressure and the first reduced pressure, the second reduced pressure being less than the atmospheric pressure and greater than the first reduced pressure; and water vapor discharging means for discharging water vapor by performing a plurality of third roughing steps between a third reduced pressure and a fourth reduced pressure, the third and fourth reduced pressures being less than the first reduced pressure and the third reduced pressure being greater than the fourth reduced pressure, wherein each one of the vaporizing step, the water discharge step and the water vapor discharging step occurs at the melting temperature of at least 273 K.

11. The water regeneration apparatus according to claim 10, wherein the temperature increasing means is achieved by one or more of a reverse rotation of a motor of the refrigerator, a purge gas, and a heater.

12. A cryopump comprising the water regeneration apparatus according to claim 10.

13. A water trap comprising the water regeneration apparatus according to claim 10.

14. A water regeneration method for discharging ice condensed in a portion cooled by a cryogenic refrigerator installed in a case to an outside of the case, comprising:

a temperature increasing step for melting the ice into water at an approximate atmospheric pressure of approximately 100,000 Pa and at a melting temperature of at least 273 K;

after the temperature increasing step, a vaporizing step for vaporizing water by performing a plurality of first roughing steps between the approximate atmospheric pressure of approximately 100,000 Pa and a first reduced pressure of approximately 100 Pa being higher than and yet close to a water-freezing pressure that causes the water to freeze;

after the vaporizing step, a water discharge step for discharging water by performing a plurality of second roughing steps between a second reduced pressure of approximately 200 Pa and the first reduced pressure of approximately 100 Pa; and after the water discharge step, a water vapor discharging step for discharging water vapor by performing a plurality of third roughing steps between a third reduced pressure of approximately 15 Pa and a fourth reduced pressure of approximately 10 Pa, wherein each one of the vaporizing step, the water discharge step and the water vapor discharging step occurs at the melting temperature of at least 273 K.

* * * * *